US008216646B2

(12) United States Patent
Flippin et al.

(10) Patent No.: US 8,216,646 B2
(45) Date of Patent: Jul. 10, 2012

(54) METHOD OF MAKING WINDOW SHADES INCORPORATING TREATED NON-WOVEN FABRIC

(75) Inventors: James William Flippin, Greensboro, NC (US); Samuel Mark Gillette, Burlington, NC (US)

(73) Assignee: Precision Fabrics Group, Inc., Greensboro, NC (US)

( * ) Notice: Subject to any disclaimer, the term of this patent is extended or adjusted under 35 U.S.C. 154(b) by 248 days.

(21) Appl. No.: 12/575,225

(22) Filed: Oct. 7, 2009

(65) Prior Publication Data

US 2010/0018645 A1 Jan. 28, 2010

Related U.S. Application Data

(62) Division of application No. 11/870,467, filed on Oct. 11, 2007.

(51) Int. Cl.
*D06B 1/00* (2006.01)
*D06B 19/00* (2006.01)
*A47H 23/00* (2006.01)

(52) U.S. Cl. ..... 427/412; 427/209; 427/421.1; 427/427.4; 427/428.01; 427/430.1

(58) Field of Classification Search ..... 427/209, 427/407.1, 412, 421.1, 427.4, 428.01, 430.1; 106/15.05
See application file for complete search history.

(56) References Cited

U.S. PATENT DOCUMENTS

| | | | | |
|---|---|---|---|---|
| 5,188,160 | A * | 2/1993 | Jelic | 160/84.02 |
| 5,395,402 | A * | 3/1995 | Duckett | 8/115.6 |
| 5,436,064 | A | 7/1995 | Schnegg et al. | |
| 6,066,382 | A * | 5/2000 | Swiszcz et al. | 428/116 |
| 6,165,920 | A * | 12/2000 | Rubin et al. | 442/226 |
| 2004/0197125 | A1 * | 10/2004 | Unger et al. | 400/76 |
| 2005/0215147 | A1 * | 9/2005 | Masters et al. | 442/59 |

FOREIGN PATENT DOCUMENTS

EP 0 648 888 A1 * 4/1995

* cited by examiner

*Primary Examiner* — William Phillip Fletcher, III
(74) *Attorney, Agent, or Firm* — Myers Bigel Sibley & Sajovec, P.A.

(57) ABSTRACT

A method of manufacturing a window shade includes applying an aqueous composition to one or both surfaces of a nonwoven fabric, wherein the aqueous composition includes a pleat retention component, an antistatic component, a stain-resistant component, and an antimicrobial component. The treated nonwoven fabric is dried and then indicia is printed on the finished surface(s). Portions of a treated nonwoven fabric may be formed into pleats and adhesively bonded together to form a cellular-type window shade.

10 Claims, 1 Drawing Sheet

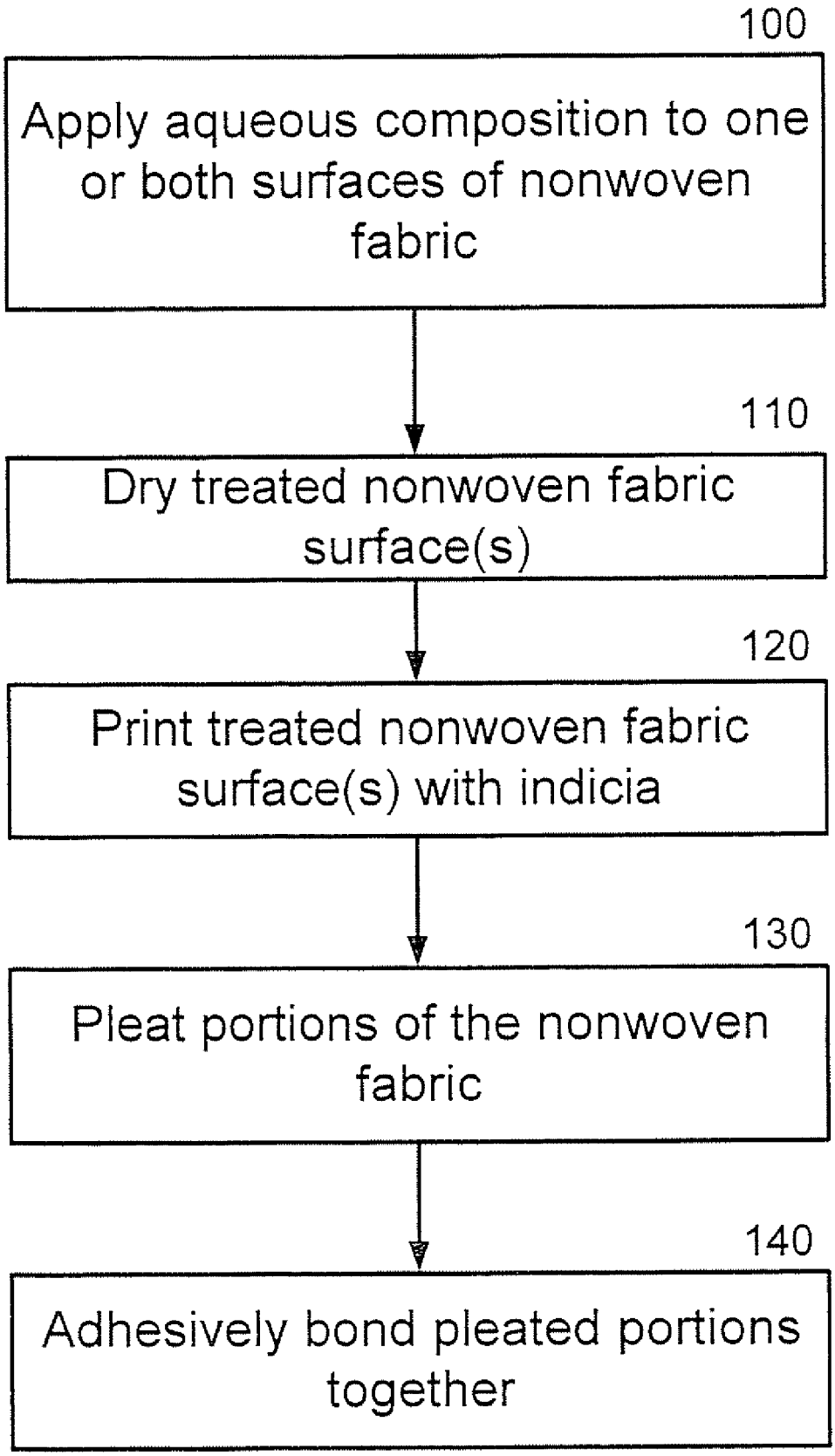
100
Apply aqueous composition to one or both surfaces of nonwoven fabric
110
Dry treated nonwoven fabric surface(s)
120
Print treated nonwoven fabric surface(s) with indicia
130
Pleat portions of the nonwoven fabric
140
Adhesively bond pleated portions together

METHOD OF MAKING WINDOW SHADES INCORPORATING TREATED NON-WOVEN FABRIC

RELATED APPLICATION

This application is a divisional application of pending U.S. patent application Ser. No. 11/870,467 filed Oct. 11, 2007, which is incorporated herein by reference in its entirety.

FIELD OF THE INVENTION

The present invention relates generally to window shades and, more particularly, to fabrics used in window shade construction.

BACKGROUND OF THE INVENTION

Nonwoven fabrics have been used in window shades in both home and commercial applications for many years. For example, nonwoven fabrics have been used in pleated and cellular-type shades, and in vertical blinds and Roman-type shades. Conventionally, nonwoven window shade fabrics are treated with a pleat retention finish that allows the nonwoven fabric to form and maintain sharp, crisp pleats that hold up during window shade use. The pleat retention finish is configured to supply stiffness between pleats and flexibility in the pleats themselves to allow proper opening and closing. In some applications, pleats are glued in such a way to form cells for cellular-type shades.

Because window shade fabrics often are printed with decorative patterns and the like, these fabrics conventionally are not treated for stain resistance because stain resistant finishes tend to make the fabrics highly repellant, which may cause problems with printing ink adhering to the fabric. Highly repellant fabrics may cause problems with gluing, as well. Glue may not adhere properly to a fabric with a stain-resistant finish and this may cause cells of a window shade to come apart during use.

Fabrics used in window shade construction are conventionally not treated for mildew and fungus growth. Unfortunately, window shades can be susceptible to mildew and fungus growth which not only hurts the overall appearance of a window shade, but also can adversely affect the physical properties of a window shade.

SUMMARY

In view of the above discussion, nonwoven fabrics having stain-resistance and antimicrobial characteristics that are suitable aesthetically as window shade material are provided. According to some embodiments of the present invention, nonwoven fabric is treated with an aqueous composition comprised of a pleat retention component, such as an emulsion polymer or copolymer, a stain-resistant component, generally a fluoropolymer, along with an antimicrobial component, and an antistatic agent. The amount of each component in the finish bath and the application method of the finish on the nonwoven fabric are controlled to insure that the nonwoven fabric can still be printed and subsequently pleated and glued into a window shade product.

According to some embodiments of the present invention, a method of manufacturing a window shade includes applying an aqueous composition to one or both surfaces of a nonwoven fabric, wherein the aqueous composition includes a pleat retention component, an antistatic component, a stain-resistant component, and an antimicrobial component. The treated nonwoven fabric is dried and then indicia is printed on the finished surface(s). In some embodiments of the present invention, portions of a treated nonwoven fabric may be formed into pleats and adhesively bonded together to form a cellular-type window shade.

BRIEF DESCRIPTION OF THE DRAWINGS

FIG. 1 is a flow diagram of operations for manufacturing a window shade, according to some embodiments of the present invention.

DETAILED DESCRIPTION

The present invention now is described more fully hereinafter with reference to the accompanying drawing, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

According to some embodiments of the present invention, stain-resistant nonwoven fabrics that do not interfere with printing and gluing operations during window shade manufacturing are provided. Nonwoven fabrics according to some embodiments of the present invention are treated with an aqueous composition having a pleat retention component, a stain-resistant component, an antimicrobial component, and an antistatic component. Nonwoven fabrics treated as such demonstrate stain resistance to many common household products that might stain a non-treated nonwoven fabric, and demonstrate resistance to the growth of mildew and other unwanted microorganisms. In addition to providing protection from unsightly mold and mildew, nonwoven fabrics according to embodiments of the present invention are resistant to bacterial and viral contamination and growth.

In some embodiments, an aqueous treatment composition includes a mixture of each finish component (i.e., pleat retention component, stain-resistant component, antimicrobial component, antistatic component) and is applied to a nonwoven fabric in a single application. In other embodiments, multiple treatment compositions, each containing one or more finish components (i.e., pleat retention component, stain-resistant component, antimicrobial component, antistatic component) are added sequentially, or in layers upon a nonwoven fabric. Finish component amount and concentration are selected such that a treated nonwoven fabric can subsequently be printed, and can be pleated and glued into a window shade product.

Nonwoven fabrics, according to embodiments of the present invention, may contain fibers of polyester, polypropylene, polyethylene, nylon, and cellulose, or blends of two or more of these types of fibers, and may be formed by any of various known nonwoven formation methods including, but not limited to, spunlacing (i.e., hydroentangling), spunbonding, and thermal bonding. An aqueous treatment composition, according to embodiments of the present invention, includes a mixture of water, a polymeric latex component, an antistatic component, a fluorochemical component, and an antimicrobial component. Several auxiliary chemicals, such as a wetting agent and an antifoam agent, may also be included to facilitate coating of the treatment composition, as would be understood by one skilled in the art of the present invention.

A treatment composition can be applied to a nonwoven fabric using various methods known in the art, such as by saturation (i.e., dip and nip), foam, kiss, spray coating, and printing. The method of coating determines how much of the fabric is actually coated. For example, using saturation coating, the nonwoven fabric is entirely submersed in a coating bath to insure complete coverage of the fabric. After the fabric is saturated, it is then nipped between pad rolls to a desired wet pick-up. This insures a thorough penetration of the coating into the fabric. The amount of wet pick-up can vary depending on the nonwoven fabric and the method of application, but generally is in the range of from about 75%-150% percent for a saturation coating. The coating is then dried and cured on the fabric at an elevated temperature, generally in the range of 300° F. to 420° F., depending on the type of nonwoven fabric and the weight of the nonwoven fabric. An elevated temperature is utilized to insure that the coating components are functional after application to the fabric. The amount of drying time can vary, but generally 25 seconds to 1 minute is sufficient.

Stain Resistant Component

In some embodiments of the present invention, a stain resistant component is a fluorochemical of the type known to impart soil and stain resistant characteristics to a fabric. Applicants have unexpectedly discovered that fluorochemicals, when used as a stain resistant component, have the added benefit of not interfering with the subsequent processes of printing a treated nonwoven fabric and then gluing and pleating the nonwoven fabric into a window shade. Fluorochemicals derive their repellency properties by lowering the critical surface tension of the nonwoven fabric surface they are applied to below that of a wetting liquid, thereby providing a barrier to penetration. Fluorochemicals, according to embodiments of the present invention, are unique in that they do not interfere with the wetting characteristics of a liquid such as a printing ink, but do create a barrier to soil and many household staining products. Moreover, fluorochemicals, according to embodiments of the present invention, do not interfere with the wetting characteristics of glue and, thus, do not interfere with gluing operations when forming the nonwoven fabric into a window shade.

In some embodiments of the present invention, the amount of fluorochemical applied to a nonwoven fabric is generally between about 0.5% to 4.0% of the weight of the fabric. In some embodiments of the present invention, the fluorochemical contains between about 25% to 35% solids.

Antistatic Component

In some embodiments of the present invention, an antistatic component is selected from a class of non-durable-type antistatic agents. Non-durable antistatic agents are not intended for use on products that see a great deal of laundering. As such, Applicants have discovered that these types of antistatic agents are sufficient for window shade applications. In some embodiments of the present invention, an antistatic component is between about 0.1% and 4% of the weight of the fabric. Exemplary non-durable antistatic components include, but are not limited to, the class of chemicals commonly known as alcohol phosphate esters and have a solids content of between about 45% to 55%. Zelec TY from Stepan is a suitable non-durable-type antistatic component, for example. The antistatic component insures that the fabric can be further processed without large amounts of unwanted static buildup, and prevents the fabric from electrostatically attracting dust and dirt both in processing and in actual use.

Pleat Retention Component

In some embodiments of the present invention, a pleat retention component is a polymeric latex component having between about 0.5% to 35% of the weight of the fabric. The polymeric latex provides pleat retention and, to some degree, a certain amount of stiffness to a pleated and glued window shade product. Exemplary pleat retention components include, but are not limited to, acrylic copolymer products such as Rhoplex HA-16 or Rhoplex TR-407 from Rohm and Hass. A solids content of between about 40% to 60% is typical for such an acrylic copolymer product. The pleat retention finish imparts stiffness and thermal shrinkage properties to the fabric to make it better suited for a window shade application.

Antimicrobial Component

In some embodiments of the present invention, an antimicrobial component is between about 0.1% to 4% of the weight of the fabric. An exemplary antimicrobial component includes, but is not limited to, zinc omadine, available from Arch Chemicals, Inc. (Norwalk, Conn.), Triclosan, silver containing antimicrobials, polyhexamthylene biguanide, copper containing antimicrobials, isothiazalone types, and silane quaternary products such as AEM 5700 from Aegis (Singapore, Indonesia). Zinc omadine is a bactericide and fungicide agent that is safe for general skin contact. Zinc omadine is also compatible with other finish components in treatment baths, according to embodiments of the present invention (i.e., pleat retention component, stain-resistant component, antimicrobial component, antistatic component). An exemplary form of zinc omadine is a 48% water soluble dispersion with a pH of about 6 to 8.

Referring now to FIG. 1, methods of manufacturing a window shade, according to some embodiments of the present invention, are illustrated. An aqueous composition is applied to one or both surfaces of a nonwoven fabric (Block 100). The nonwoven fabric may be, for example, a spunlaced nonwoven, a spunbonded nonwoven, or a thermal bonded nonwoven, formed from one or more of the following types of fibers: polyester fibers, polypropylene fibers, polyethylene fibers, nylon fibers, and cellulose fibers. As described above, the aqueous composition includes a pleat retention component, an antistatic component, a stain-resistant component, and an antimicrobial component. For example, the pleat retention component may be an emulsion polymer or copolymer, the antistatic component may be a non-durable antistatic component such as, for example, an alcohol phosphate ester, and the stain-resistant component may be a fluoropolymer. In some embodiments, the antistatic component is about 0.1% to 4% by weight of the nonwoven fabric, the stain-resistant component is about 0.05% to 4% by weight of the nonwoven fabric, and the antimicrobial component is about 0.01% to 4% by weight of the nonwoven fabric. The aqueous composition may be applied to the nonwoven fabric surface(s) as a finish bath, a coating compound, foam, froth, or print paste via any of various known methods including, but not limited to, saturation coating, foam coating, kiss coating, spray coating, or printing.

The treated nonwoven fabric surface(s) is subjected to elevated temperatures to dry the applied treatment composition (Block 110). The treated nonwoven fabric can then be printed with graphics, images, text, etc. (collectively referred to as "indicia") (Block 120).

If the nonwoven fabric is to be manufactured into a pleated, cellular-type window shade, portions of the nonwoven fabric are pleated (Block 130) and one or more of the pleated portions may be adhesively bonded together (Block 140).

EXAMPLE 1

A spunlaced nonwoven fabric comprised of polyester fibers, with an untreated basis weight of 68 gsm (grams per square meter), was immersed into a finish bath containing 0.5% by bath weight Isopropyl alcohol (penetrant), 0.8% by bath weight Rhoplex HA-16 (copolymer latex), 3.6% by bath weight Barpel SR-DA (fluorochemical stain-release agent), 0.9% by bath weight Zelec TY (antistatic agent), 0.9% by bath weight Zinc Omadine (antimicrobial agent) and 93.3% by bath weight of water. The finish bath was applied to the nonwoven fabric by a dip and nip technique (saturation finish) using a lab padder apparatus. The wet pick-up of the nonwoven fabric was about 140% in the finish bath. The wet fabric was then dried and cured in a lab oven set at 400° F. for a dwell time of 30 seconds.

Test results of the treated fabric are set forth below in Table 1:

TABLE 1

| | |
|---|---|
| Basis weight | 2.1 oz/yd$^2$ (71 gsm) |
| Grab tensile | 43 lbs. in the MD (machine direction) and 18 lbs. in the XD (cross direction) |
| Elongation | 53% in the MD and 200% in the XD |
| Caliper (thickness) | 0.018 inches |
| Handle-o-meter (measure of fabric stiffness) | 10 grams in the MD and 3 grams in the XD |
| Water drop absorbency | 30+ seconds |
| Oil absorbency (corn oil) | 30+ seconds |

EXAMPLE 2

A spunlaced nonwoven fabric comprised of polyester fibers, with an untreated basis weight of 68 gsm, was foam finished using a bath containing 0.1% by weight of Unifroth 1672 (foaming agent), 4.7% by weight of Hystretch V-43HX (elastomeric copolymer), 1.7% by weight of Rhoplex TR-407 (acrylic latex), 7.0% by weight of Barpel SR-DA (fluorochemical stain-release agent), 0.9% by weight of Zelec TY (antistatic agent), 0.9% by weight of Zinc Omadine (antimicrobial agent), and 84.7% by weight of water. The finish bath was foamed on both sides of the nonwoven fabric at a wet pick-up of about 70% on each side. The foam finished fabric was then dried and cured in an oven set at 400° F. for a dwell time of 40 seconds.

Test results of the treated fabric are set forth below in Table 2:

TABLE 2

| | |
|---|---|
| Basis weight | 1.9 oz/yd$^2$ (64 gsm) |
| Grab tensile | 28 lbs. in the MD (machine direction) and 14 lbs. in the XD (cross direction) |
| Elongation | 54% in the MD and 247% in the XD |
| Caliper (thickness) | 0.017 inches |
| Handle-o-meter (measure of fabric stiffness) | 32 grams in the MD and 5 grams in the XD |
| Water drop absorbency | 30+ seconds |
| Oil absorbency (corn oil) | 30+ seconds |

EXAMPLE 3

A spunlaced nonwoven fabric comprised of polyester fibers, with an untreated basis weight of 68 gsm, was foam finished using a bath containing 0.1% by weight of Unifroth 1672 (foaming agent), 4.7% by weight of Hystretch V-43HX (elastomeric copolymer), 1.7% by weight of Rhoplex TR-407 (acrylic latex), 7.0% by weight of Barpel SR-DA (fluorochemical stain-release agent), 0.9% by weight of Zelec TY (antistatic agent), 0.9% by weight of Zinc Omadine (antimicrobial agent), and 84.7% by weight of water. The finish bath was foamed on one side of the nonwoven fabric at a wet pick-up of about 70%. The foam finished fabric was then dried and cured in an oven set at 400° F. for a dwell time of 40 seconds.

Stain Resistance Test

According to other embodiments of the present invention, a test for determining the amount of stain resistance a nonwoven fabric exhibits in a window shade application is provided, and is referred to as the Precision Fabrics Group Stain Resistance Test (PFG Test). The PFG Test uses common household staining products to generate quantitative data for assessing the degree of staining of one nonwoven window shade product versus another and is summarized as follows. A test swatch is weighed and placed on an apparatus for testing. A specified amount of liquid or semi-solid household material is then applied to the test swatch. The swatch is then re-weighed and the percent liquid regain is calculated. In addition, an assessment is made to determine the amount of staining before and after cleaning with a wet sponge containing a surfactant solution (such as Woolite® brand fabric wash).

Components of the test apparatus are listed in Table 3 below

TABLE 3

| |
|---|
| Ring and stand |
| Plastic funnel with stop cock |
| Flat incline board |
| Ball clips |
| 25 mil Graduated cylinder |
| Analytical Balance |

TABLE 3-continued

| |
|---|
| Clicker/Hytonic Press and 8" × 8" cutting die |
| Sponge and Surfactant (Woolite) |
| Aluminum or plastic weigh boats |
| Spatula |
| Various household staining products |

Textile testing is performed using standard atmosphere (70+/−2F, 65+/−2% RH, per ASTM D1776.

The PFG Test procedure is summarized below in Table 4.

TABLE 4

| |
|---|
| 1) Cut an 8" × 8" swatch of the test material using the Clicker Press or use scissors if a Clicker press is not available. Weigh the test swatch on an analytical balance to the nearest 0.01 grams. Record this weight. |
| 2) Place the test swatch on an incline board and secure the swatch to the board using Ball clips. The incline board should be at an approximately 30 degree angle to the counter top and Ring stand and positioned directly below the plastic funnel. |
| 3) Pour 10 milliters (+/−0.5 mls.) of the insult liquid into a 25 milliter Graduated cylinder. Pour the contents of the Graduated cylinder into the plastic funnel. Open the stop cock of the funnel and allow the entire amount of the insult liquid to flow over the surface of the test swatch. Wait 15 seconds before removing the test swatch from the incline board. Hold the test swatch over a sink and gently shake the swatch to remove any liquid that might still be on the surface of the test swatch. Reweigh the swatch on an analytical balance. Record this weight to the nearest 0.01 grams. |
| 4) Calculate the difference between the original weight of the test swatch and the weight after testing. This weight (in grams) is the amount of liquid insult left in the swatch. This can be converted to a percentage by dividing this weight by the original weight and multiplying by 100. |
| 5) Assess the amount of staining on the test swatch as light, moderate, or heavy. Also, make note if the stain is confined to only the area of the initial impact or if the stain carries down the entire length of the test swatch. |
| 6) Make a cleaning solution using one-half cap full of Woolite ® brand fabric wash into one-half liters of tap water. Use a sponge soaked in this solution to clean the stain on the test swatch. Note whether the stain is removed using the sponge alone or if soaking the test swatch in a beaker of tap water removes the stain (soak the swatch after applying the soap solution using a sponge). Note also if the stain is light, moderate, or heavy after cleaning with the soap solution. |
| 7) If the insult product is semi-solid (such as ketchup or mustard), use the following procedure: Weigh 3 grams (+/−0.1 grams) of the insult material into a plastic or aluminum weigh boat. Apply the insult material to the pre-weighed test swatch using a spatula. Use the spatula to make a spot about two inches in diameter on the test swatch. Use a paper towel to remove excess insult material by wiping off the spot three times (three passes over the spot). Reweigh the test swatch and calculate the amount of semi-solid material left in the test swatch. Use the same procedure as above (step 6) to assess the staining characteristics of the test swatch. |
| 8) Report the weight of either the liquid or the semi-solid insult material left in the test swatch. Also, report the degree of staining before and after cleaning with a soap solution. |

Swatches of fabric from Examples 1 and 2 above were tested using the above test method for determining stain resistance. These swatches were compared to swatches using the same base substrate but finished with a pleat retention finish minus the stain resistant and antimicrobial components. A number of liquid insults were used to evaluate stain resistance including corn oil, grape juice, milk, coffee, cola, mustard, and ketchup. In all cases, the swatches from Examples 1 and 2 above outperformed the finished swatches that did not contain the stain resistant and antimicrobial components. For example, when corn oil was tested on swatches from Example 1, there was a 2% add-on (0.1 grams) compared to a 136% add-on (5.1 grams) for swatches that contained only the pleat retention finish. Also, swatches from Examples 1 and 2 did a better job of repelling the liquid insults and showed less overall staining than the finished swatches that were minus the stain resistant and antimicrobial components.

Antimicrobial testing was done using AATCC (American Association of Textile Chemists and Colorists) Test Method 30 and AATCC Test Method 147. The results for test method 147 showed that there was no growth in the contact area and a zone of inhibition of 2.5 mm for Examples 1 and 2 above. Both were tested using *Staphylococcus aureus* and *Klebsiella pneumoniae*. The control which is the pleat retention finish minus the stain resistant and antimicrobial components, showed growth in the contact area and no zone of inhibition. Results for Test Method 30 show Examples 1 and 2 having no growth to light growth using Aspergillus Niger on mineral salt agar with 3% glucose. The control sample showed light growth to heavier growth.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A method of manufacturing a window shade, comprising:

treating an entire surface of a nonwoven fabric with an aqueous composition that comprises a pleat retention component, an antistatic component, a stain-resistant component, and an antimicrobial component;

drying the treated surface; and printing ink directly on the dried treated surface to form indicia thereon.

2. The method of claim 1, further comprising forming pleated portions in the nonwoven fabric.

3. The method of claim 2, further comprising applying adhesive directly on the dried treated surface and then adhesively bonding one or more of the pleated portions directly together via the adhesive.

4. The method of claim 1, wherein the aqueous composition is applied to the entire nonwoven fabric surface by saturation coating, foam coating, kiss coating, spray coating, or printing.

5. The method of claim 1, wherein the aqueous composition is applied to the entire nonwoven fabric surface as a finish bath, a coating compound, foam, froth, or print paste.

6. The method of claim 1, wherein the aqueous composition is applied entirely to both surfaces of the nonwoven fabric.

7. The method of claim 1, wherein the pleat retention component comprises an emulsion polymer or copolymer.

8. The method of claim 1, wherein the antistatic component comprises one of a non-durable antistatic component or an alcohol phosphate ester.

9. The method of claim 1, wherein the antistatic component comprises about 0.1% to 4% by weight of the nonwoven fabric.

10. The method of claim 1, wherein the antimicrobial component comprises about 0.01% to 4% by weight of the nonwoven fabric.

* * * * *